United States Patent [19]

Murray

[11] Patent Number: 4,842,229

[45] Date of Patent: Jun. 27, 1989

[54] PAINT BUCKET HOLDER

[76] Inventor: Alvin Murray, Rt. #2, Box 198A, Douglas, Ga. 31533

[21] Appl. No.: 238,144

[22] Filed: Aug. 30, 1988

[51] Int. Cl.[4] ..... E04D 15/00

[52] U.S. Cl. ..... 248/148; 248/237; 182/45

[58] Field of Search ..... 248/237, 148; 182/45, 182/121, 122

[56] References Cited

U.S. PATENT DOCUMENTS

| | | | |
|---|---|---|---|
| 298,463 | 5/1884 | Guedle | 248/237 |
| 590,872 | 9/1897 | Allen | 248/237 |
| 606,100 | 6/1898 | Thompson | 248/148 |
| 1,026,097 | 5/1912 | Lewis | 248/237 |
| 1,036,945 | 8/1912 | Wilkerson | 248/237 |
| 1,112,876 | 10/1914 | Widlund | 248/237 |
| 1,193,307 | 8/1916 | Sorley | 248/148 |
| 1,423,726 | 7/1922 | Mohr | 248/237 |
| 2,504,800 | 4/1950 | Campagna | 248/148 |
| 2,750,139 | 6/1956 | Young | 248/148 |
| 2,837,305 | 6/1958 | Andrew | 248/148 |
| 3,028,135 | 4/1962 | Funderburg | 248/237 |
| 4,450,935 | 5/1984 | Gustavus | 248/237 |

*Primary Examiner*—Reinaldo P. Machado
*Attorney, Agent, or Firm*—John B. Dickman, III

[57] ABSTRACT

A portable adjustable roof platform for use by painters on inclined roof surfaces. The roof platform has two moving parts for quickly adjusting the platform vertically to a horizontal position.

2 Claims, 2 Drawing Sheets

PAINT BUCKET HOLDER

BACKGROUND OF THE INVENTION

This invention relates to a platform for inclined surfaces such as built-up roofs, and more particularly to portable and adjustable platforms for supporting paint buckets on inclined roofs.

The purpose of any roof platform is to provide a horizontal surface on built-up roofs. Several U.S. Patents are directed to adjustble roof platforms. An example of one type of roof platform is shown in U.S. Pat. No. 298,463 where vertical adjustment is accomplished by vertical leg sections with interfitting notches on each section and set screws. Another type of roof platform is found in U.S. Pat. Nos. 590,872, 1,026,097 and 1,112,876 in which adjustment is made by moving a pivotable bar connected to a horizontal platform along a slotted vertical upright and tightening the bar at the proper angle. A more recent solution is shown in U.S. Pat. No. 4,450,935 where a toggle mechanism between a platform and flat frame is adjusted by a screw actuating handle. Each of the above U.S. Patents, except U.S. Pat. No. 4,450,935, utilizes spikes or barbs which imbed into the roof to hold the platform in place.

Adjustment of the roof platform is critical when transporting the platform to roofs of different pitch. The above cited U.S. Patents provide infinite adjustments. However, with the exception of U.S. Pat. Nos. 298,463 and 4,450,935 the patents depend on heavy tightening forces to provent the locking bolt from slipping, causing the platform to collapse. Whereas U.S. Pat. No. 4,450,935 requires more moving parts which increases manufacturing cost, but provides non-slip locking. U.S. Pat. No. 298,463 has incrimental adjustments and tightening screws which positively locks, however the leg sections are expensive to manufacture. Thus, a need exists for an adjustable roof platform that is simple to adjust and is inexpensive to manufacture. Further, the platform has an upright wall for containing paint cans.

SUMMARY OF THE INVENTION

The present invention provides an adjustable roof platform that is easily and rapidly adjustable to conform to various roof pitches. The adjustable roof platform includes a horizontal base with vertical rod receiving female members. The base is made of a reinforced frame with an expanded metal platform. An upright wall is affixed to the metal platform to support paint buckets. Atleast one adjustable rod is slidable in the female member to adjust the horizontal base to the angle of pitch of the roof. A locking thumb screw is threaded into the female member to engage the rod, locking it in place. The rod has a roof engaging end with a point to slightly embed itself in the roof.

Another embodiment of the invention provides the adjustable rod with a plurality of drilled holes for receiving the thumb screw, making a positive locking arrangement to avoid any slipping of the rod.

DESCRIPTION OF THE INVENTION

Figure 1:
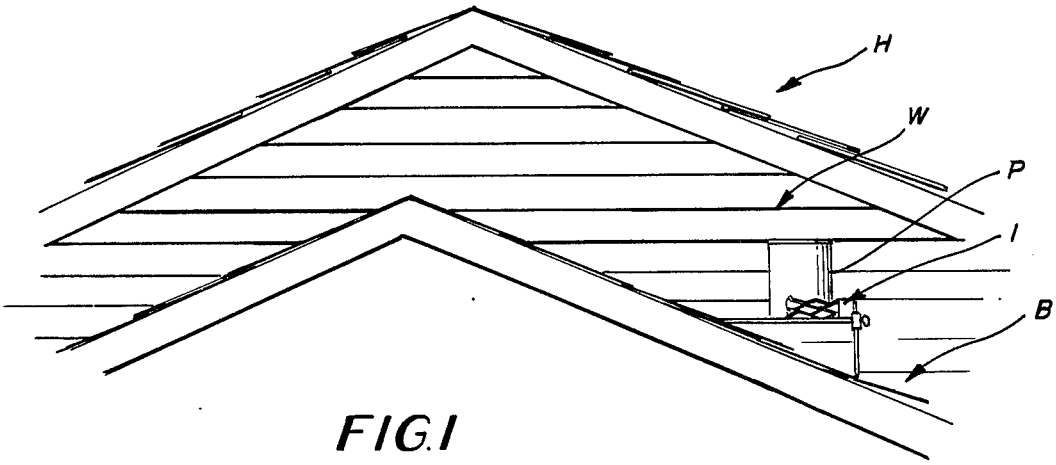
FIG. 1 is a side view of a house roof showing a roof platform of the invention.

Referring to the drawings there is shown in FIG. 1 a house H have a roof A and a second roof B. there is a wall W covered with a painted surface, such as siding. In order to paint the wall W, a painter stands on roof B with his paint supplies. To make it easier to do the paint job, a roof platform 1 of the invention is shown supporting a paint bucket P. It is understood that the use of the roof platform 1 of the present inventinon is not limited to a particular occupation. For instance, the present platform is suitable for carpenters and roofers.

Figure 2:
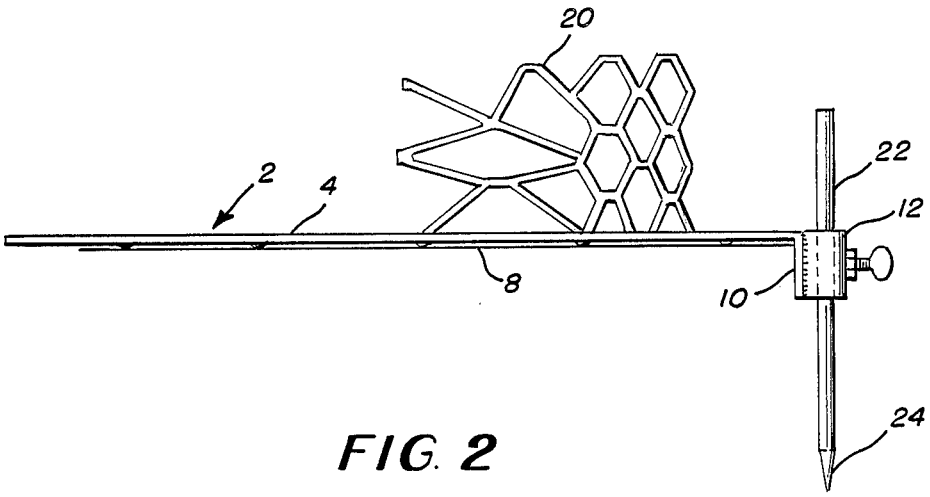
FIG. 2 is a side view of a roof platform of the invention.

In accordance with the present invention, the roof platform 1 includes a base 2, reinforced with side frame members 4 welded to cross frame members 6 for strength. Welded to the frame members 4 and 6 is a platform supporting base 8 made of expanded metal. FIG. 2 shows side frame member 4 with a right angle front member 10 and a female rod receiving member 12 welded to it. The rod receiving member 12 has a bore 14 on one side which is threaded to receive a thumb screw 16 in FIG. 6.

Figure 3:
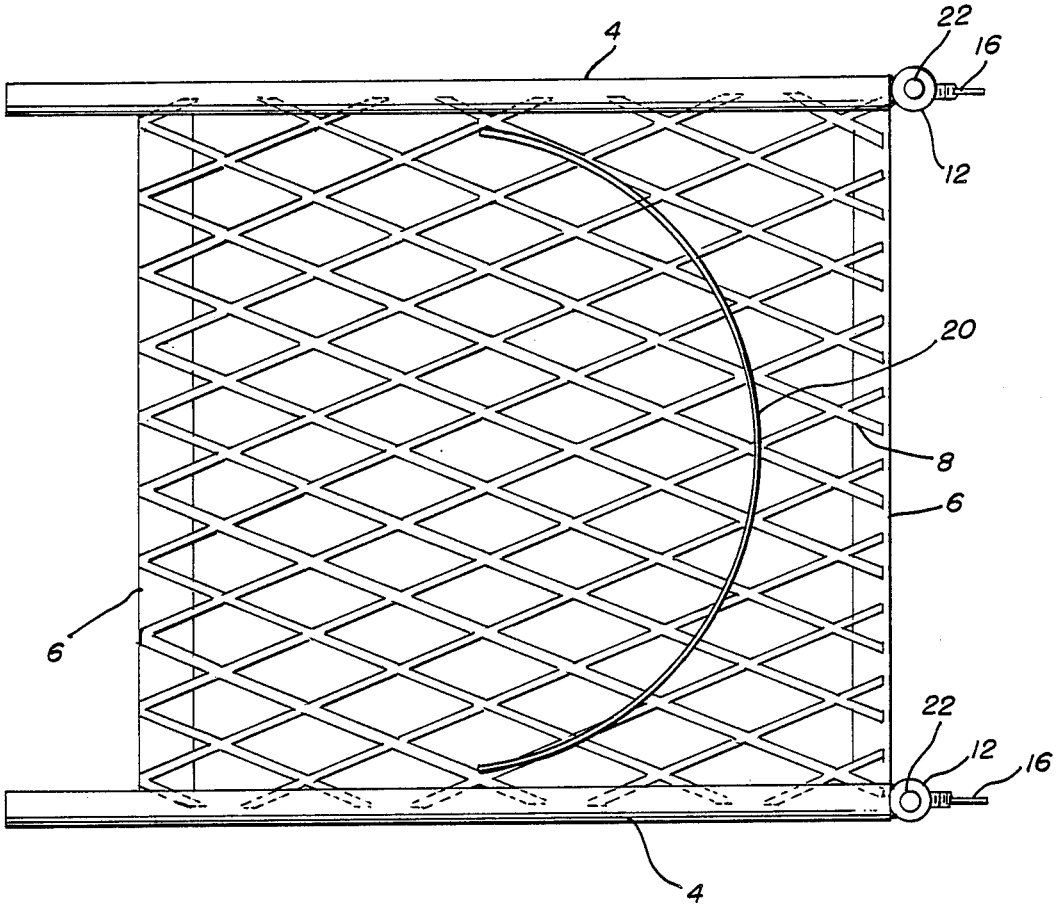
FIG. 3 is a top view of a roof platform of the invention.

A retaining wall 20 is shown in FIGS. 2 and 3. The upright wall 20 is arcuate to accommodate a painter's bucket. The upright wall 20 is made of an expanded metal that is welded to platform 8, which gives additional reinforcement to the platform.

Figure 4:
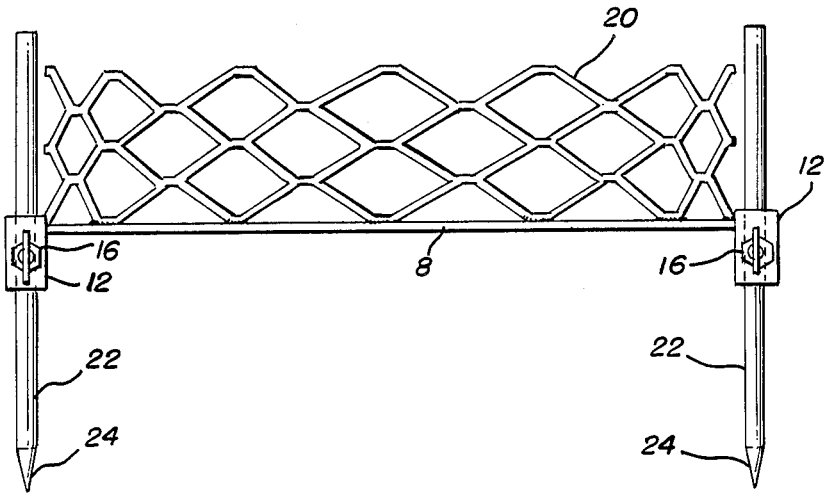
FIG. 4 is a front view of a roof platform of the invention.

FIG. 4 shows the upright wall 20 and a pair of vertical adjusting rods 22. Each adjusting rod is atleast 8 inches long and has a pointed end 24. The rod 22 slides inside female member 12 to adjust the platform base 2 to a horizontal position on any roof having a pitch of 8 inches or less. Pointed end 24 embeds itself in the roof to present the roof platform 1 from sliding down the incline. While the point 24 embeds in the roof it does not penetrate it deeply enough to cause lasting harm. After the proper position has been located the thumb screws 16 are tightened to hold the platform securely.

Figure 5:
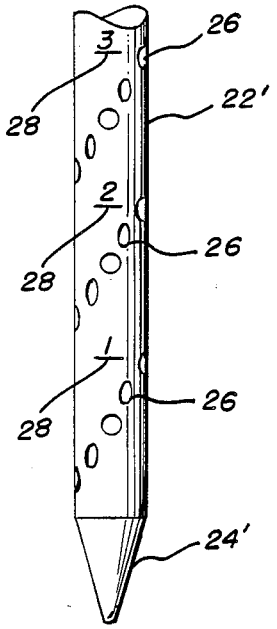
FIG. 5 is a front view of a rod of the present invention.

Another embodiment of the adjusting rod is shown in FIG. 5. The rod 22 has a pointed end 24 similar to rod 20. Rod 22 has a plurality of drilled holes 26 around its surface. These holes 26 are spirally arranged on the rod to provide almost infinite adjustments vertically. The number of holes 26 may vary according to need, however there will be atleast one hole every vertical half inch. At every vertical one inch there is an indication line 28 which aligns with the top of the female member 12, with indicia to show every one inch rise to correspond to roof pitch of 1;12, 2;12, 3;12, 4;12 and so on. When line 28 aligns with the top of the female member 12, and in vertical alignment with the bore 14 in the female member 26, thereby preventing the rod 22 from slipping.

While only two embodiments of the invention have been disclosed, it is understood that one skilled in the art may realize other embodiments. Therefore, one should consider the description, claims and drawings for a full understanding of the invention.

I claim:

1. A portable adjustable roof platform for use on an inclined roof comprising:

a horizontal platform base having a structural frame means and a supporting base affixed to said frame means, said structural frame means having side frame means with right angle end means, said supporting base comprises expanded metal and has an upright arcuate wall affixed to it to retain a paint bucket;

a pair of female rod receiving members on said right angle end means of said side frame means, each female rod receiving member including a threaded screw bore means and a thumb screw means for tightening a rod member in locked position;

a pair of rod members slidable in said female rod receiving members for vertically adjusting said roof platform to a horizontal position when on an inclined roof;

and said pair of rod members haivng pointed ends to embed themselves in said roof to prevent movement;

and include holes in a spiral line around the surfaces of said rods to provide incremental adjustment vertically of said platform.

2. An adjustable roof platform as in claim 1 wherein alignment lines are provided every vertical inch to align with the top olf said female rod receiving member, and indica to indicate the vertical rise in inches.

* * * * *